US011052303B2

(12) United States Patent
Ayer

(10) Patent No.: US 11,052,303 B2
(45) Date of Patent: Jul. 6, 2021

(54) GUARD FOR IN-LINE ROLLER SKATE

(71) Applicants: Terry Robinson, Victoria (CA); Gordon Ayer, Victoria (CA)

(72) Inventor: Gordon Ayer, Victoria (CA)

(73) Assignee: BRAVO HOME PRODUCTS LTD., Victoria (CA)

( * ) Notice: Subject to any disclaimer, the term of this patent is extended or adjusted under 35 U.S.C. 154(b) by 13 days.

(21) Appl. No.: 16/681,189

(22) Filed: Nov. 12, 2019

(65) Prior Publication Data

US 2021/0121768 A1 Apr. 29, 2021

(30) Foreign Application Priority Data

Oct. 25, 2019 (CA) ..... CA 3060131

(51) Int. Cl.
*A63C 17/00* (2006.01)
*A63C 17/06* (2006.01)

(52) U.S. Cl.
CPC ..... *A63C 17/002* (2013.01); *A63C 17/06* (2013.01)

(58) Field of Classification Search
CPC .... A63C 17/002; A63C 17/06; A63C 17/0006
See application file for complete search history.

(56) References Cited

U.S. PATENT DOCUMENTS 5,269,580 A * 12/1993 Hsiao ..... A63C 17/0006 294/162
5,290,065 A * 3/1994 Kassal ..... A63C 17/20 280/11.231
5,503,433 A * 4/1996 Lachapelle ..... A63C 17/002 188/4 R
5,573,275 A * 11/1996 Smith ..... A63C 17/002 280/811
5,580,094 A * 12/1996 Ruehlman ..... A63C 17/002 280/811
5,765,870 A * 6/1998 Riley ..... A63C 17/002 280/825
5,836,425 A * 11/1998 Ahlstrom ..... A43B 5/16 188/4 R
5,848,808 A * 12/1998 Fenton ..... A63C 17/002 280/825
5,855,381 A * 1/1999 Kirk ..... A63C 17/002 280/11.207
5,951,049 A * 9/1999 Calverley ..... A63C 17/002 188/4 R
6,079,747 A * 6/2000 Winsor ..... A63C 17/002 280/811

(Continued)

FOREIGN PATENT DOCUMENTS

CA 2 176 769 A1 11/1997

*Primary Examiner* — Brian L Swenson
(74) *Attorney, Agent, or Firm* — Finch & Maloney, PLLC; Michael J. Bujold

(57) ABSTRACT

There is provided a guard for an in-line roller skate, which includes an elongated member defining a wheel receiving channel. The channel has a bottom and a pair of opposed sidewalls, which extend upwardly from the bottom terminating in a remote edge. The remote edge of the sidewalls define a wheel insertion opening to receive wheels of an in-line roller skate. At least one transverse roller is positioned across the channel near the remote edge of the sidewalls.

9 Claims, 3 Drawing Sheets

(56) References Cited

U.S. PATENT DOCUMENTS

| | | | | |
|---|---|---|---|---|
| 6,193,277 | B1 * | 2/2001 | Marasco | A63C 17/002 280/809 |
| 6,382,485 | B1 * | 5/2002 | Hoagland | B62J 11/00 224/419 |
| 7,192,059 | B2 | 3/2007 | Guyon et al. | |
| 2004/0124627 | A1 * | 7/2004 | Cuerrier | A63C 17/20 280/809 |
| 2004/0140661 | A1 * | 7/2004 | Guyon | A63C 17/002 280/825 |
| 2005/0040638 | A1 * | 2/2005 | Riley | A63C 17/06 280/825 |
| 2005/0127661 | A1 * | 6/2005 | Cuerrier | A63C 17/002 280/825 |
| 2006/0157969 | A1 * | 7/2006 | Baker | A63C 17/20 280/825 |

* cited by examiner

GUARD FOR IN-LINE ROLLER SKATE

FIELD

There is described a guard for an in-line roller skate.

BACKGROUND

Many businesses do not allow customers to wear in-line roller skates while at the business premises. This policy is based upon a legitimate concern that a person wearing roller skates may crash into other patrons or crash into merchandize displays. The policy is also based upon liability concerns, should the person wearing roller skates experience a fall while on the business premises.

Users of in-line roller skates are greatly limited in the number of activities that they can engage in while wearing their in-line roller skates, by virtue of the fact that the skates are designed to roll. They must remove their in-line roller skates and don normal footwear each time they engage in such activities as climbing up or down stairs or walking up and down steep grades.

There are guards for in-line roller skates disclosed in the patent literature, such as published Canadian patent application 2,176,769 (Fenton) titled "Roller Blade Guard" and U.S. Pat. No. 7,192,059 (Guyon et al) titled "In-line Skate Guard".

SUMMARY

There is provided a guard for an in-line roller skate, which includes an elongated member defining a wheel receiving channel. The channel has a bottom and a pair of opposed sidewalls, which extend upwardly from the bottom terminating in a remote edge. The remote edge of the sidewalls define a wheel insertion opening to receive wheels of an in-line roller skate. At least one transverse roller is positioned across the channel near the remote edge of the sidewalls.

While the guard, as described above, will work with just one transverse roller, having two or more transverse rollers positioned across the channel at spaced intervals is preferred. The rollers serve a number of functions. The rollers assist in guiding the wheels of an in-line roller skate the channel. The rollers also prevent the in-line roller skate from moving axially along the channel. The rollers also serve to maintain the connection between the channel and the in-line roller skate, so the guard does not fall off the in-line roller skate when a user raises his or her foot when walking.

While the guard will work as described above, having open ends at each of the opposed ends of the channel will add flexibility to the channel. Flexible sidewalls are preferred. Increasing flexibility in the channel and sidewalls will allow the user to more easily pop the guard on and off of an in-line skate.

Although the guard will work as described above, it has been determined that the guard will work best when the sidewalls converge near the remote edge. The sidewalls converge such that wheels of an in-line roller skate are maintained within the channel by a clamping force of the remote edges. Having converging sidewalls increases the holding force of the channel on a skate.

Further, while the guard will work as described above, it is preferred that the remote edges of the sidewalls terminate in opposed diverging guide flanges that guide wheels of an in-line roller skate into the channel. It serves to strengthen the top of the guide channel and increase the ease of use of the guard for a user as a user may stomp down on the guard without exact precision and be guided into the channel by the guide flanges.

The bottom of the channel can be said to have an inner surface (positioned within the channel) and an outer surface (underlying the elongated member). Lastly, it preferred that one or more pads be positioned on the outer surface. Such pads provide a dampening effect and enables the user to walk around with minimal noise, added traction and without scuffing or otherwise damaging flooring. The pads on the bottom of the guard are a convenience that provide additional comfort and safety, but are not necessary for the guard to function as designed.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
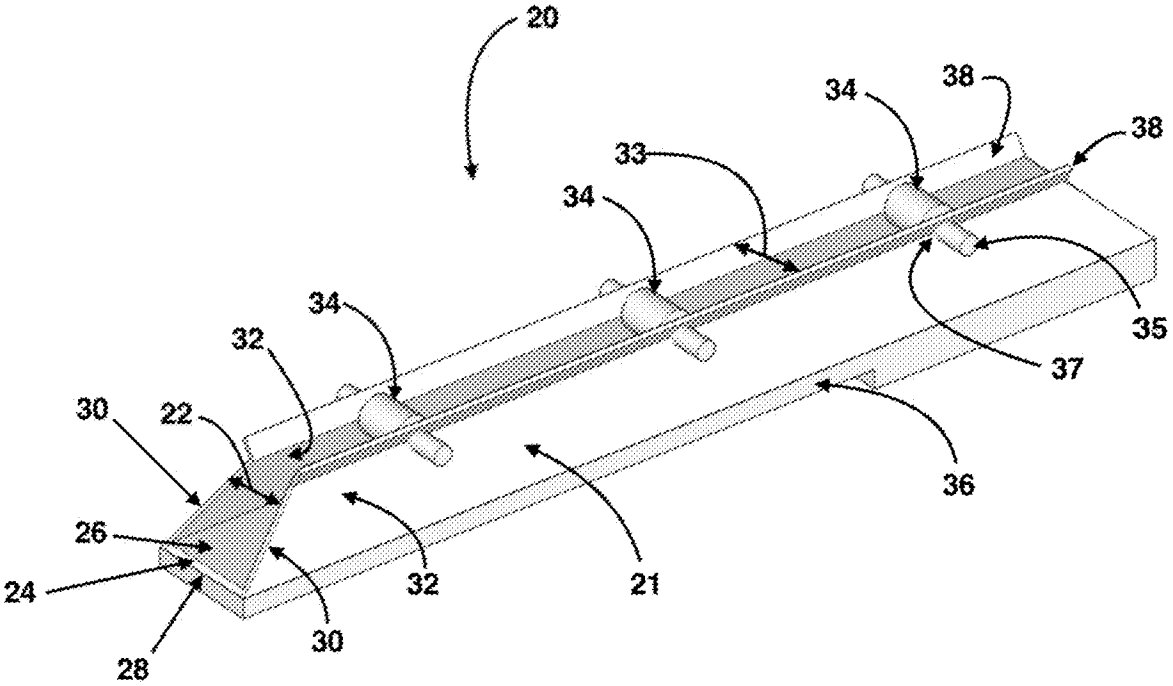
FIG. 1 is a perspective view of a guard for an in-line roller skate.

A guard, generally identified by reference numeral 20, will now be described with reference to FIG. 1 through FIG. 3.

Structure and Relationship of Parts:

Referring to FIG. 1, guard 20 includes an elongated member 21 defining a wheel receiving channel 22. Wheel receiving channel 22 can be considered to have a bottom 24 with an inner surface 26 (within channel 22) and an outer surface 28 (serving as a bottom for elongated member 21). A pair of opposed flexible sidewalls 30 extend upwardly from bottom 24 and converge terminating in a remote edges 32, which defines a wheel insertion opening 33.

Three transverse rollers 34 are positioned across channel 22 at spaced intervals near remote edge 32 of sidewalls 30. Rollers 34 have shafts 35 that are journaled in openings 37 along remote edge 32 of sidewalls 30. It is generally preferred that the number of rollers correspond with one less than the number of wheels on a user's in-line roller skate.

There are one or more pads 36 on outer surface 28 of bottom 24.

Sidewalls 30 terminate in opposed diverging guide flanges 38. Referring to FIG. 2, as will hereinafter be further described, wheels 102 of an in-line roller skate 100 are guided by guide flanges 38 into channel 22.

Referring to FIG. 1, channel 22 is illustrated as having opposed ends that are open at each of the opposed ends. Open opposed ends are preferred as they lend towards more flexible sidewalls 30. Having sidewalls 30 that are flexible is preferred as it assists in the ease of insertion and removal of guard 20 from an in-line roller skate. However, it will be appreciated that the ends do not have to be open as long as any closure positioned at the ends do not reduce the clamping effect of sidewalls 30 on the wheels of the in-line roller skate.

Figure 2:
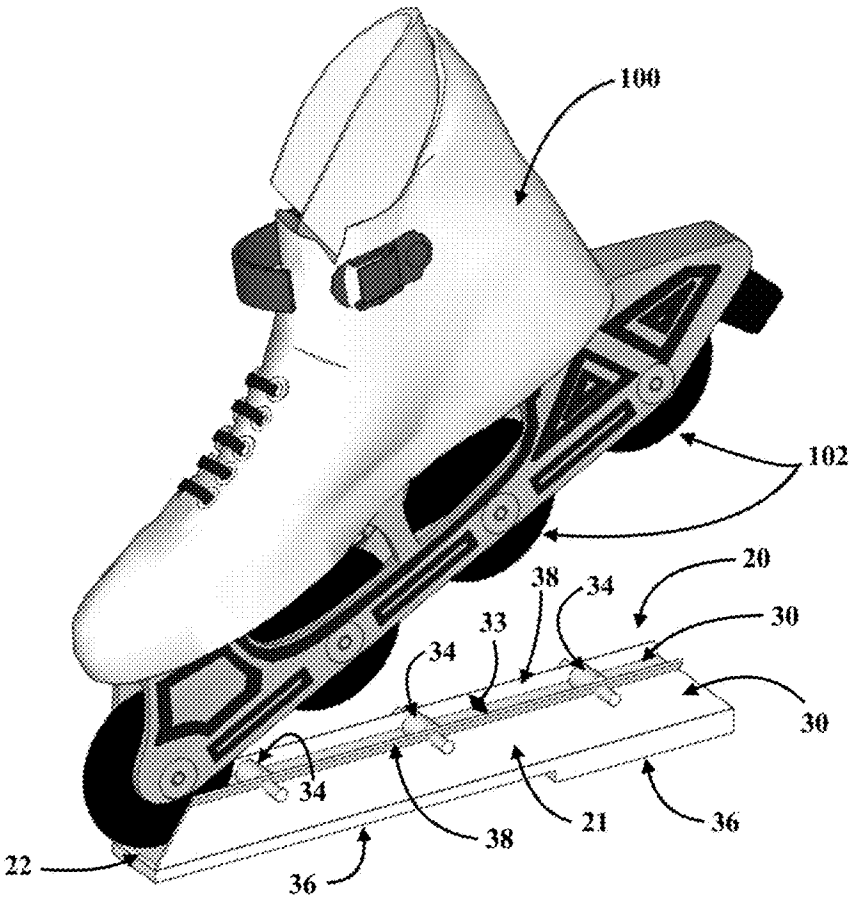
FIG. 2 is a perspective view of the guard of FIG. 1, showing in-line roller skate insertion into the guard.

Operation:

Referring to FIG. 2, a user starts by aligning in-line roller skate 100 with channel 22 of guard 20, such that rollers 34 are positioned in between wheels 102 of in-line roller skate 100. Once rollers 34 are positioned in between wheels 102, the user exerts a downward force upon guide flanges 38 by stepping down with his or her heel. The downward forces sidewalls 30 to diverge and wheels 102 of in-line roller skate 100 are guided by guide flanges 38 into channel 22. Referring to FIG. 3, once wheels 102 of in-line roller skate 100 are in channel 22, sidewalls 30 resiliently return back to their original state to exert a clamping force on the wheels 102. Rollers 34 are wedged in between wheels 102 and provide an additional holding force. The clamping force of converging sidewalls 30 and the wedging of rollers 34 in between wheels 102 of in-line roller skate 100 provide the hold necessary to keep in-line roller skate 100 in channel 22 of guard 20. Such a hold enables the user to walk around with guard 20 firmly attached to in-line roller skate 100. Wheels of an in-line roller skate are maintained within channel 22 by a clamping force created by converging sidewalls 30. Axial movement of in-line roller skate 100 along channel 22 is precluded by rollers 34.

Figure 3:
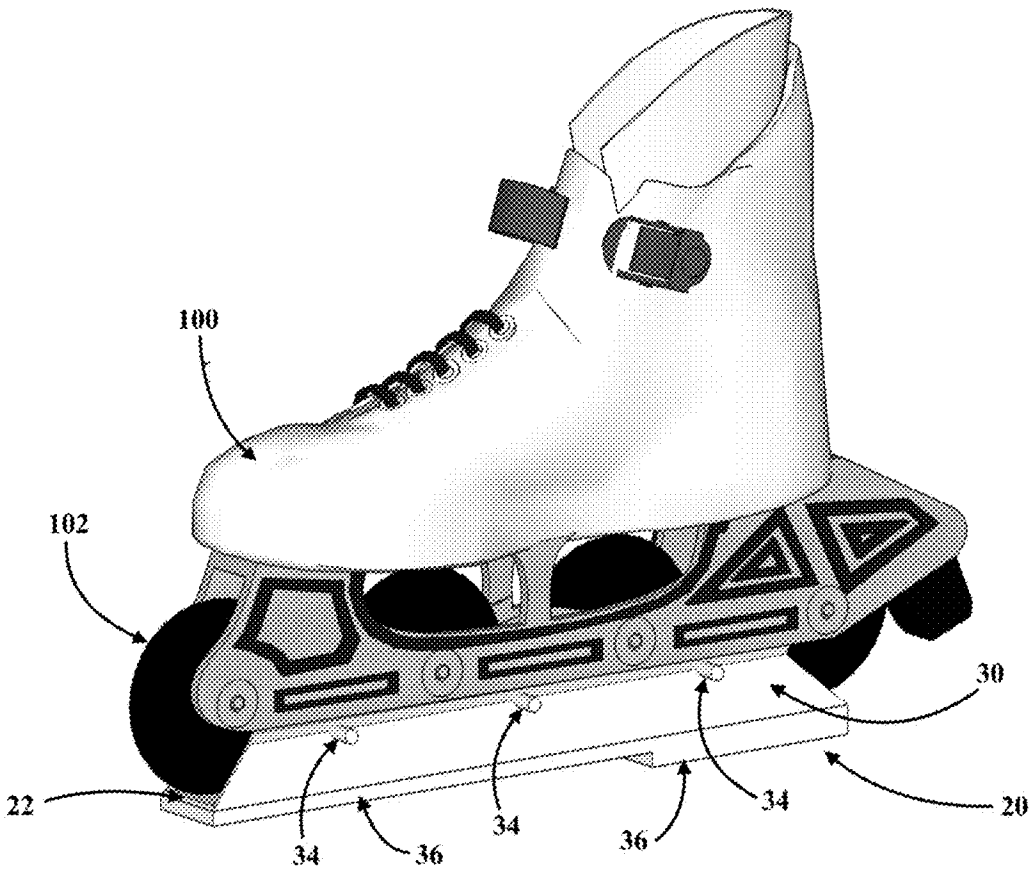
FIG. 3 is a perspective view of the guard of FIG. 1, with an in-line roller skate fully inserted to the guard.

Referring to FIG. 1 and FIG. 3, Pads 36 on outer surface 28 of bottom 24 allows the user to walk around indoor establishments without making much noise and also protects indoor flooring from scratches. Pads 36 also provide the benefit of added traction to prevent the user from slipping while walking around with guard 20 attached to in-line roller skate 100.

To remove guard 20 from the in-line roller skate, the user simply needs to exert force to pull guard 20 downwards and away from wheels 102 of in-line roller skate 100. In doing so, sidewalls 30 diverge and rollers 24 roll to allow wheels 102 to slide out of channel 22. As shown in FIG. 1, once the wheels are out of channel 22, sidewalls 30 return back to their original convergent state. It is best to find a stable object to support yourself, lift skate up and then pull straight down to remove guard 20.

Advantages:

The method of attachment of the above described guard allows a user to quickly and easily attach and remove the guard to and from a pair of in-line roller skates. This ease of use is ideal as it allows the user to travel over difficult or dangerous terrain, go up or down stairs, go up or down slopes or move in and out of indoor establishments seamlessly and without hassle. Such a feature complements a widespread adoption of rollerblades as a form of commute.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A guard for an in-line roller skate, comprising:

an elongated member defining a wheel receiving channel, the channel having a bottom and a pair of opposed sidewalls which extend upwardly from the bottom terminating in a remote edge, the remote edge of the sidewalls defining a wheel insertion opening to receive wheels of an in-line roller skate, and the sidewalls converge, such that wheels of an in-line roller skate are maintained within the channel by a clamping force of the remote edges of the sidewalls; and at least one transverse roller positioned across the channel near the remote edge of the sidewalls.

2. The guard of claim 1, wherein there are two or more transverse rollers positioned across the channel at spaced intervals.

3. The guard of claim 1, wherein the channel has opposed ends, the channel being open at each of the opposed ends.

4. The guard of claim 1, wherein the sidewalls are flexible.

5. The guard of claim 1, wherein the remote edges of sidewalls terminate in opposed diverging guide flanges that guide wheels of an in-line roller skate into the channel.

6. The guard of claim 1, wherein the bottom has an inner surface and an outer surface and one or more pads are positioned on the outer surface.

7. A guard for an in-line roller skate, comprising:

an elongated member defining a wheel receiving channel, having a bottom with an inner surface and an outer surface and a pair of opposed flexible sidewalls which extend upwardly from the bottom and converge terminating in a remote edge which defines a wheel insertion opening;

two or more transverse rollers positioned across the channel at spaced intervals near the remote edge of the sidewalls;

one or more pads on the outer surface of the bottom;

wherein the sidewalls terminate in opposed diverging guide flanges, such that wheels of an in-line roller skate are guided into the channel by the guide flanges and maintained within the channel by a clamping force created by the converging sidewalls and axial movement of the in-line roller skate along the channel is precluded by the rollers.

8. The guard of claim 7, wherein the channel having opposed ends are open at each of the opposed ends.

9. A guard for an in-line roller skate comprising:

an elongated member defining a wheel receiving channel, the channel having a bottom and a pair of opposed sidewalls which extend upwardly from the bottom terminating in a remote edge, the remote edge of the sidewalls defining a wheel insertion opening to receive wheels of an in-line roller skate; and at least one transverse roller positioned across the channel near the remote edge of the sidewalls;

wherein the remote edges of sidewalls terminate in opposed diverging guide flanges that guide wheels of an in-line roller skate into the channel.

* * * * *